US005613872A

United States Patent [19]

Fukuda et al.

[11] Patent Number: 5,613,872

[45] Date of Patent: Mar. 25, 1997

[54] CONNECTION SENSOR AND SHORT-CIRCUITING CONTACT FOR CONNECTOR

[75] Inventors: Masaru Fukuda; Eiji Fukuda, both of Shizuoka, Japan

[73] Assignee: Yazaki Corporation, Tokyo, Japan

[21] Appl. No.: 341,079

[22] Filed: Nov. 17, 1994

[30] Foreign Application Priority Data

Nov. 18, 1993 [JP] Japan ..... 5-289153

[51] Int. Cl.[6] ..... H01R 3/00

[52] U.S. Cl. ..... 439/489; 439/188

[58] Field of Search ..... 439/489, 490, 439/188; 200/51.09, 51.11

[56] References Cited

U.S. PATENT DOCUMENTS

| | | | |
|---|---|---|---|
| 4,900,267 | 2/1990 | Nagasaka et al. | 439/489 |
| 5,055,058 | 10/1991 | Nagasaka et al. | 439/188 |
| 5,131,865 | 7/1992 | Taguchi et al. | 439/489 |
| 5,174,776 | 12/1992 | Ohtaka et al. | 439/188 |
| 5,263,872 | 11/1993 | Marpoe, Jr. et al. | 439/188 |
| 5,277,608 | 1/1994 | Oda | 439/188 |

FOREIGN PATENT DOCUMENTS

| | | | |
|---|---|---|---|
| 4311767 | 10/1993 | Germany . | |
| 0241778 | 9/1989 | Japan | 439/489 |

*Primary Examiner*—Hien Vu

*Attorney, Agent, or Firm*—Sughrue, Mion, Zinn, Macpeak & Seas

[57] ABSTRACT

A connector includesvone connector housing having a flexible lock arm, other connector housing having an engagement portion corresponding to the flexible lock arm, a short-circuiting contact member having resilient contact pieces, the short-circuiting contact member arranged on a displacement allowing space side of the flexible lock arm in the one connector housing, the resilient contact pieces being displaced in accordance with displacement of the flexible lock arm; and a pair of connection sensing pin-type terminal fittings arranged so as to confront the short-circuiting contact member in the other connector housing, wherein when the pair of connector housings are connected incompletely, the flexible lock arm is displaced to displace the resilient contact pieces so as to break contact of the resilient contact pieces with the connection sensing pin-type terminal fittings.

5 Claims, 5 Drawing Sheets

CONNECTION SENSOR AND SHORT-CIRCUITING CONTACT FOR CONNECTOR

BACKGROUND OF THE INVENTION

1. Field of the Invention

The invention relates to a connection sensor and short-circuiting contact for a pair of connectors used for connecting wire harnesses of an automobile or the like, the connection sensor and short-circuiting contact having a means for sensing complete connection of the pair of connectors.

2. Related Art

In FIGS. 8 and 9, reference character A denotes a male connector housing; and B, a female connector housing. Each connector housing is molded using a synthetic resin material.

As is well known, the male connector housing A has a plurality of terminal accommodating chambers 1 to allow a female terminal fitting C to be inserted thereinto and retained therein. Similarly, the female connector housing B has a plurality of terminal accommodating chambers (not shown) to allow a male terminal fitting D to be inserted thereinto and retained therein.

A cantilevered flexible lock arm 3 having a rising base portion 3*a* at a front end thereof extends rearward in a recessed portion 2 on the upper surface of the male connector housing A. A lock protuberance 3*b* is arranged on the upper surface in a middle portion of the flexible lock arm 3 and unlock press operation portions 3*c* are arranged on the free end thereof. An engagement frame portion 5 corresponding to the flexible lock arm 3 and a retaining opening 5*a* corresponding to the lock protuberance 3*b* are arranged in a middle portion of the front end of an upper wall 4 of the female connector housing B.

The aforementioned construction is generally known. When the male and female connector housings A, B are engaged with each other, the female and male terminal fittings C, D come in contact with each other and, at this instance, the flexible lock arm 3 is flexibly displaced downward into a displacement allowing space R provided herebelow by the lock protuberance 3*b* thereof colliding against the engagement frame portion 5, and thereafter returns to its original position by the lock protuberance 3*b* having reached the retaining opening 5*a*, so that complete connection of the male and female connector housings is accomplished.

Reference numeral 6 denotes connection sensing contact, which has a resilient contact portion 6*b* erected at one end of a main plate portion 6*a* through a folded portion 6', and a tab-like male terminal portion 6*c* that extends rearward at the other end of the main plate portion 6*a* through a folded portion 6" that is folded in a direction opposite to that of the resilient contact portion 6*b*. A pair of connection sensing contacts 6, 6 are fixed by causing the folded portions 6' thereof to be fitted with the recessed portion 2 as well as an end portion of a compartment wall 8 between the terminal accommodating chambers 1', 1' neighboring the recessed portion 2. As a result, the pair of resilient contact portions 6*b*, 6*b* are erected within the displacement allowing space R so as to confront the free end portion of the flexible lock arm 3. The tab-like male terminal portions 6*c*, 6*c* are fixed rearward within the terminal accommodating chambers 1', 1'. The ordinary female terminal fittings C are connected to the tab-like male terminal portions 6*c*, 6*c*, so that a sensing circuit is formed.

Reference numeral 7 denotes an inserted U-shaped short-circuiting contact made of a resilient metal plate. The short-circuiting contact 7 has outwardly extending folded portions 7*b*, 7*b* at both leg portions 7*a*, 7*a* thereof. The short-circuiting contact 7 is fixed while fitted with confronting plate portions 5*b*, 5*b* of the engagement frame 5.

In the aforementioned construction, if the male and female connector housings A, B are connected incompletely, the free end portion of the flexible lock arm 3 not only displaces itself downward, but also forcibly displaces the resilient contact portions 6*b*, 6*b* of the connection sensing contacts 6, 6 downward as shown in FIG. 9(*b*). As a result, the contact of the short-circuiting contact 7 with the resilient contact portions 6*b*, 6*b* is broken, which makes the sensing electric circuit inoperable.

When the male and female connector housings A, B are connected completely, the flexible lock arm 3 returns to the original position thereof to cause the resilient contact portions 6*b*, 6*b* of the connection sensing contacts 6, 6 to return to the original position thereof as shown in FIG. 9(*c*), so that the resilient contact portions 6*b*, 6*b* come in contact with the short-circuiting contact 7 to thereby activate the sensing electric circuit.

In the aforementioned conventional art, a pair of connection sensing contacts are arranged in the male connector housing having the flexible lock arm and the short-circuiting contact is arranged in the female connector housing. Additionally a pair of terminal fittings are connected to the connection sensing contacts in the male connector housing. Therefore, the construction of the connection sensor is complicated.

SUMMARY OF THE INVENTION

The invention has been made in consideration of the aforementioned circumstances and an object of the invention is, therefore, to simplify the connection sensor by eliminating the connection sensing contacts in the case where the female connector is a connector used for a printed wiring board or the like.

To achieve the above object, the invention is applied to a connection sensor for a connector, which includes: one connector housing having a flexible lock arm and the other connector housing having an engagement portion corresponding to the flexible lock arm. In such connection sensor, a short-circuiting contact having resilient contact pieces is arranged on a displacement allowing space side of the flexible lock arm in the one connector housing, and the resilient contact pieces are displaced in accordance with displacement of the flexible lock arm, and a pair of connection sensing pin-type terminal fittings are arranged so as to confront the short-circuiting contact in the other connector housing. As a result of this construction, when the pair of connector housings are connected incompletely, the flexible lock arm is displaced to displace the resilient contact pieces, so that there is no longer electrical contact between the resilient contact pieces and the connection sensing pin-type terminal fittings.

Further, a connection sensor for a connector of the invention is characterized in that a pair of resilient contact pieces corresponding to the pair of connection sensing pin-type terminal fittings are juxtaposed through a slit in the short-circuiting contact.

Further, a connection sensor for a connector of the invention is characterized in that not only a pair of driven portions confronting the flexible lock arm are arranged on the pair of resilient contact pieces, but also collision portions which abut each other are arranged on a slit side of the pair of driven portions.

Still further, a connection sensor for a connector of the invention is characterized in that the pair of driven portions arranged on the pair of resilient contact pieces are caused to confront unlock press portions of the flexible lock arm.

Still further, a connection sensor for a connector of the invention is characterized in that short-circuiting contact points of the resilient contact pieces confront a wall surface of the housing therein while interposing therebetween such a distance as to allow the connection sensing pin-type terminal fittings to enter thereinto, the wall surface being located on a displacement allowing space side of the flexible lock arm.

Still further, a short-circuiting contact of the invention includes: a resilient plate portion arranged on a base plate portion through an arcuately folded base portion; and cantilevered resilient contact pieces juxtaposed with each other on the resilient plate portion and interposing a slit therebetween. In such a short-circuiting contact, not only short-circuiting contact points are arranged in intermediate portions of the resilient contact pieces, but also driven portions are erected on free end portions of the resilient contact pieces.

Still further, a short-circuiting contact of the invention is characterized in that collision portions being abutted against each other are arranged on a slit side of the pair of driven portions.

Still further, a short-circuiting contact of the invention is characterized in that covering plate portions extend from the base plate portion so as to cover the resilient plate portion.

When the pair of connectors are incompletely connected, the resilient contact pieces of the short-circuiting contact are forcibly moved away from the connection sensing pin-type terminal fittings, whereas when the pair of connectors are completely connected, the resilient contact pieces return to the original position thereof to be abutted against the connection sensing pin-type terminal fittings.

BRIEF DESCRIPTION OF THE DRAWINGS

FIG. 9(*c*) is a longitudinal sectional view of the conventional example of FIG. 8 in the completely connected state.

DETAILED DESCRIPTION OF THE PREFERRED EMBODIMENT

Figure 1:
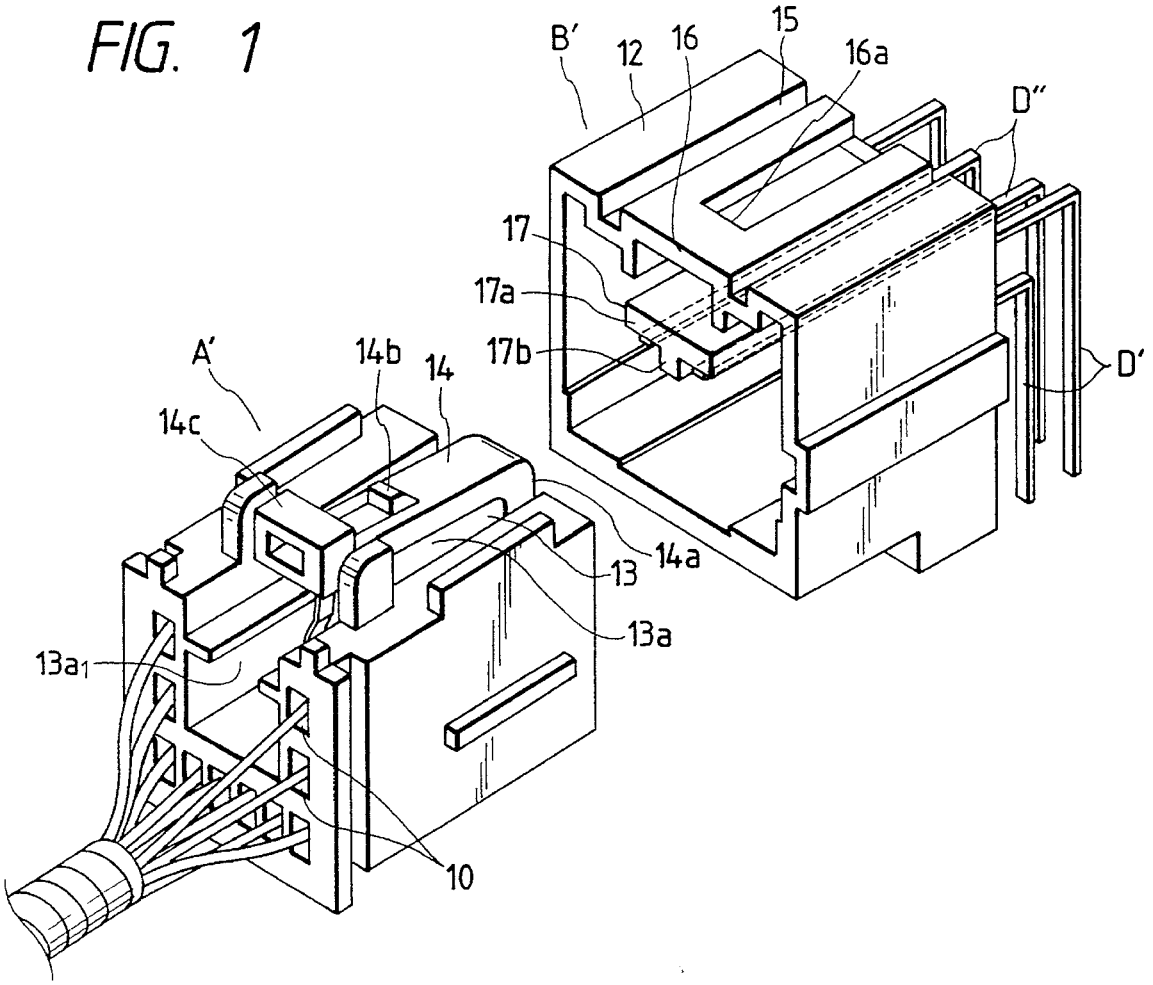
FIG. 1 is an exploded partially perspective view showing male and female connector housings of an embodiment of the invention in a separated state.
Figure 2:
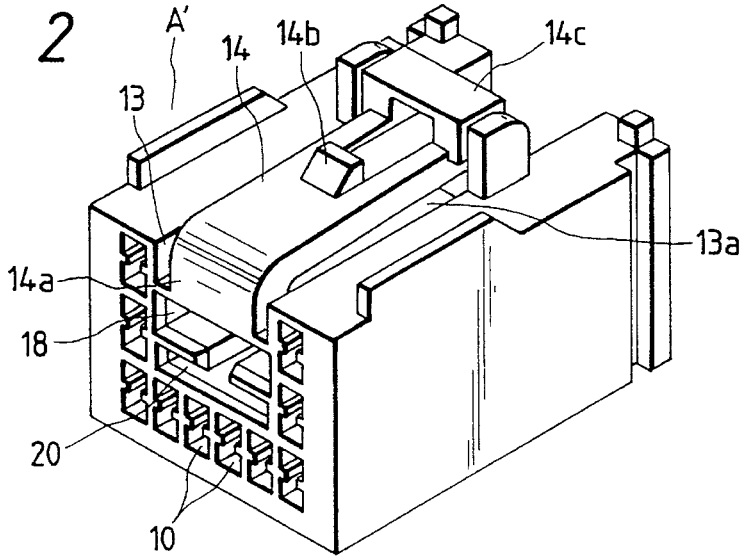
FIG. 2 is a perspective view of the male connector housing as viewed off to the front.
Figure 3:
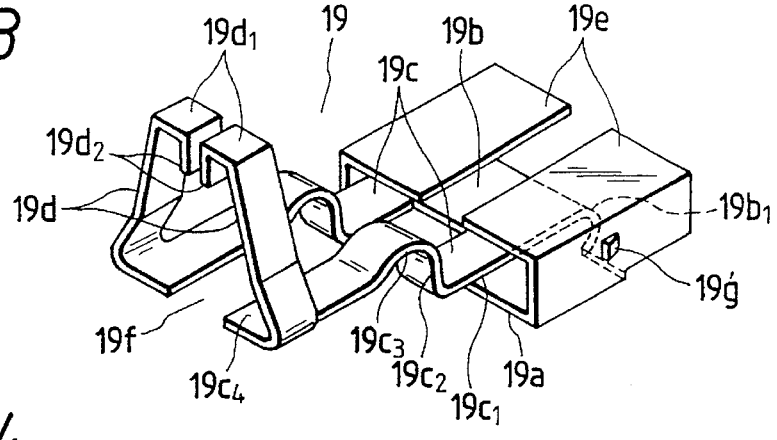
FIG. 3 is a perspective view of a short-circuiting contact.

In FIG. 1 reference character A' denotes a male connector housing; B', a female connector housing and for a printed wiring board. Each connector housing is molded using a synthetic resin material.

Figure 4:
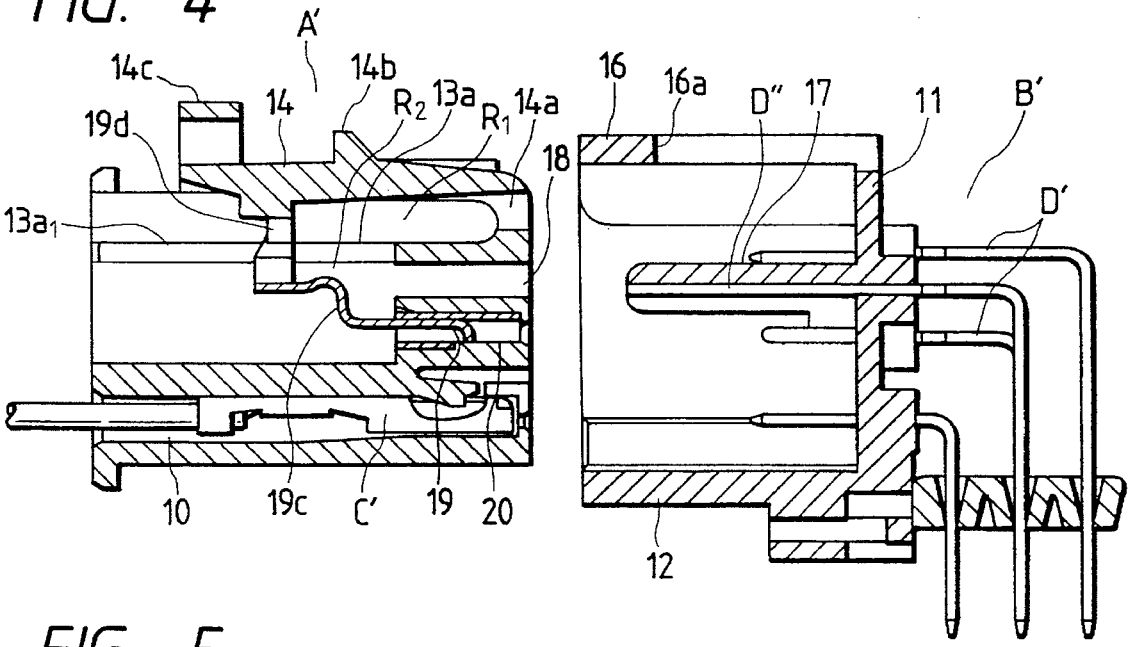
FIG. 4 is a sectional view of the male and female connector housings.

The male connector housing A' has a plurality of terminal accommodating chambers 10, and a female terminal fitting C' is inserted thereinto and retained therein (see FIG. 4). The female connector housing B' has pin-type male terminal fittings D' juxtaposed within a housing body 12 while supported by a rear wall 11 (see FIG. 4).

A cantilevered flexible lock arm in 14 having a rising base portion 14*a* at the front end thereof extends rearward in a recessed portion 13 on the upper surface of the male connector housing A'. A lock protuberance 14*b* is arranged on the upper surface of a middle portion of the flexible lock arm 14 and an unlock press portion 14*c* is arranged on the free end thereof. An engagement frame portion 16 corresponding to the flexible lock arm 14 and a retaining opening 16*a* corresponding to the lock protuberance 14*b* are arranged in a middle portion of the front end of an upper wall 15 of the female connector housing B'.

When the male and female connector housings A', B' are engaged with each other, the female and male terminal fittings C', D' come in contact with each other and, at this instance, the flexible lock arm 14 is flexibly displaced downward into a displacement allowing space $R_1$ provided therebelow by the lock protuberance 14*b* thereof colliding against the front end of the engagement frame portion 16, and thereafter returns to its original position with the lock protuberance 14*b* having reached the retaining opening 16*a*, so that complete connection of the male and female connector housings is accomplished.

A support frame portion 17 extends frontward from the rear wall 11 within the hosing body 12 of the female connector housing B'. The support frame portion 17 is substantially T-shaped in section including a partition plate portion 17*b* positioned in the middle of a flat plate portion 17*a*. A pair of connection sensing pin-type terminal fittings D" are arranged on both lateral sides of the partition plate portion 17*b* while passing through the rear wall 11. The connection sensing pin-type terminal fittings D" extend further frontward than the aforementioned pin-type male terminal fittings D'.

A substantially T-shaped opening 18 extends rearward at a position corresponding to the flexible lock arm 14 in the male connector housing A'. The opening 18 receives the support frame portion 17. Below the opening 18 is a short-circuiting contact 19 positioned in support chamber 20 with the front thereof opened.

The short-circuiting contact 19 is made of a resilient metal plate, and includes a resilient plate portion 19*b* is arranged through an arcuately folded portion $\mathbf{19}b_1$ on a base plate portion 19*a* so as to increase resilienicy, and bifurcated resilient contact pieces 19*c*, 19*c* arranged as cantilevers on the resilient plate portion 19*b* with a slit 19*f* therebetween. The respective resilient contact pieces 19*c*, 19*c* have lower flat portions $\mathbf{19}c_1$, rising portions $\mathbf{19}c_2$, arcuate short-circuiting contact points $\mathbf{19}c_3$, and upper flat portions $\mathbf{19}c_4$. Driven portions 19*d*, 19*d* are erected on the free end portions. Cover plate portions 19*e*, 19*e* are arranged above the resilient plate portion 19*b* by bending both sides of the base plate portion 19*a*. Pressure receiving plate portions 19$d_1$, 19$d_1$ are provided on top of the pair of driven portions 19*d*, 19*d*, and collision plate portions 19$d_2$, 19$d_2$ are arranged so as to confront each other by causing the inner ends of the pressure receiving portions 19$d_1$, 19$d_1$ to face downward, so that when a load is applied, these pressure receiving portions mutually support such load to prevent the driven portions 19*d*, 19*d* from deflecting inwardly. The cover plate portions 19*e*, 19*e* not only protect the resilient plate portion 19*b*, but also keep a load from the flexible lock arm 14 from being directly applied to the housing. Retaining protuberances 19*g* corresponding to the support chamber 20 are arranged on both lateral sides of the cover plate portions 19*e*, 19*e*.

The short-circuiting contact 19 is fixed by fitting the base portion 19*a* within the support chamber 20. The resilient contact pieces 19*c* extend rearward so that the short-circuiting contact points thereof 19$c_3$ confront a bottom wall 13*a* of the recessed portion 13 through a distance $R_2$ therein, and the drive portions 19*d* are abutted against the lower side of the unlock press portion 14*c* of the flexible lock arm 14 while being received in the recessed portion 13 defined by a notch 13$a_1$ of the bottom wall 13*a* (see FIG. 4). The pair of resilient contact pieces 19*c*, 19*c*, interposing the slit 19*f* therebetween, can be resiliently displaced independently of each other. Therefore, the resilient contact pieces 19*c*, 19*c* can reliably short-circuit the pair of connection sensing pin-type terminal fittings D" serving as the members to be short-circuited even if these connection sensing pin-type terminal fittings D" are displaced in the upper or lower direction.

Figure 5:
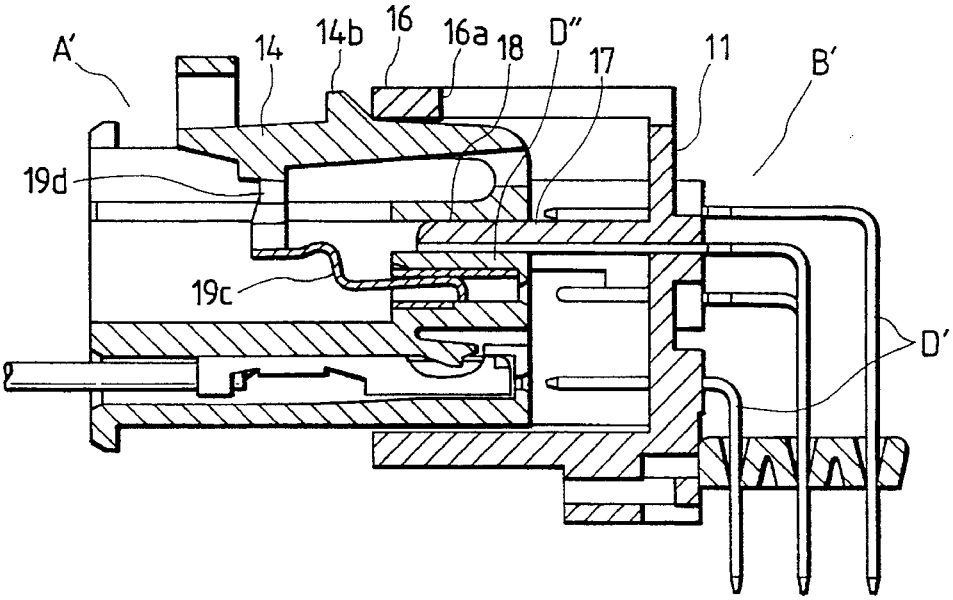
FIG. 5 is a longitudinal sectional view of the male and female connector housings at an initial stage of connection.
Figure 6:
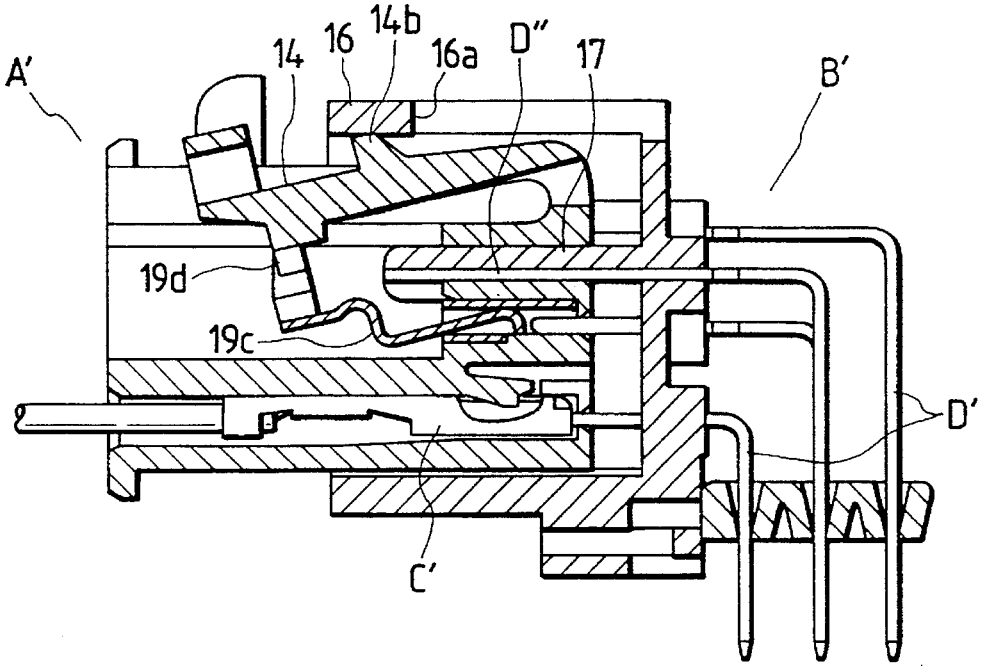
FIG. 6 is a longitudinal sectional view of the male and female connector housings in an incompletely connected state.
Figure 7:
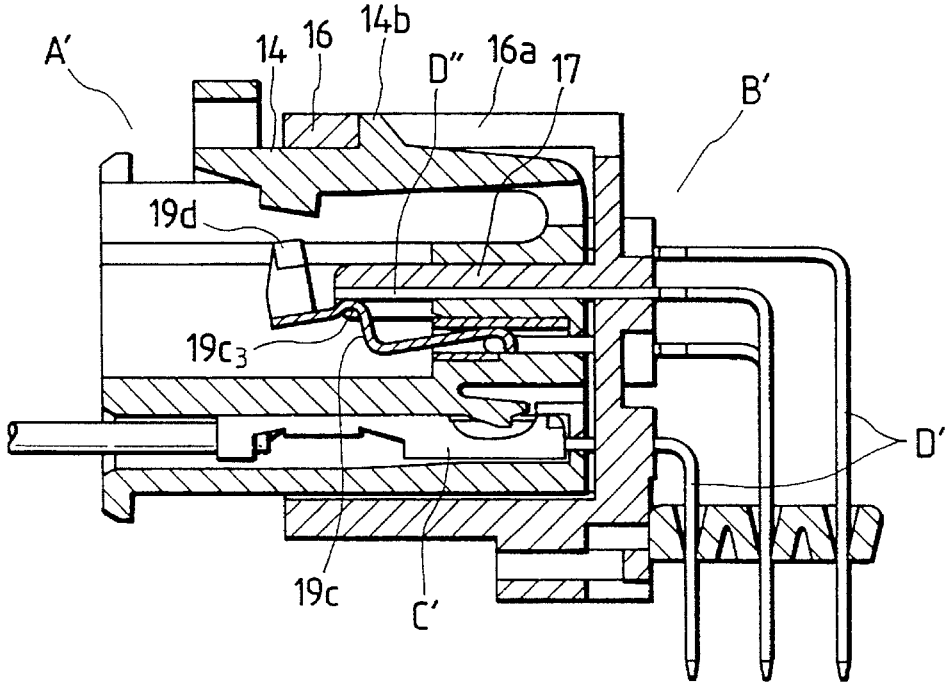
FIG. 7 is a longitudinal sectional view of the male and female connector housings in the completely connected state.
Figure 8:
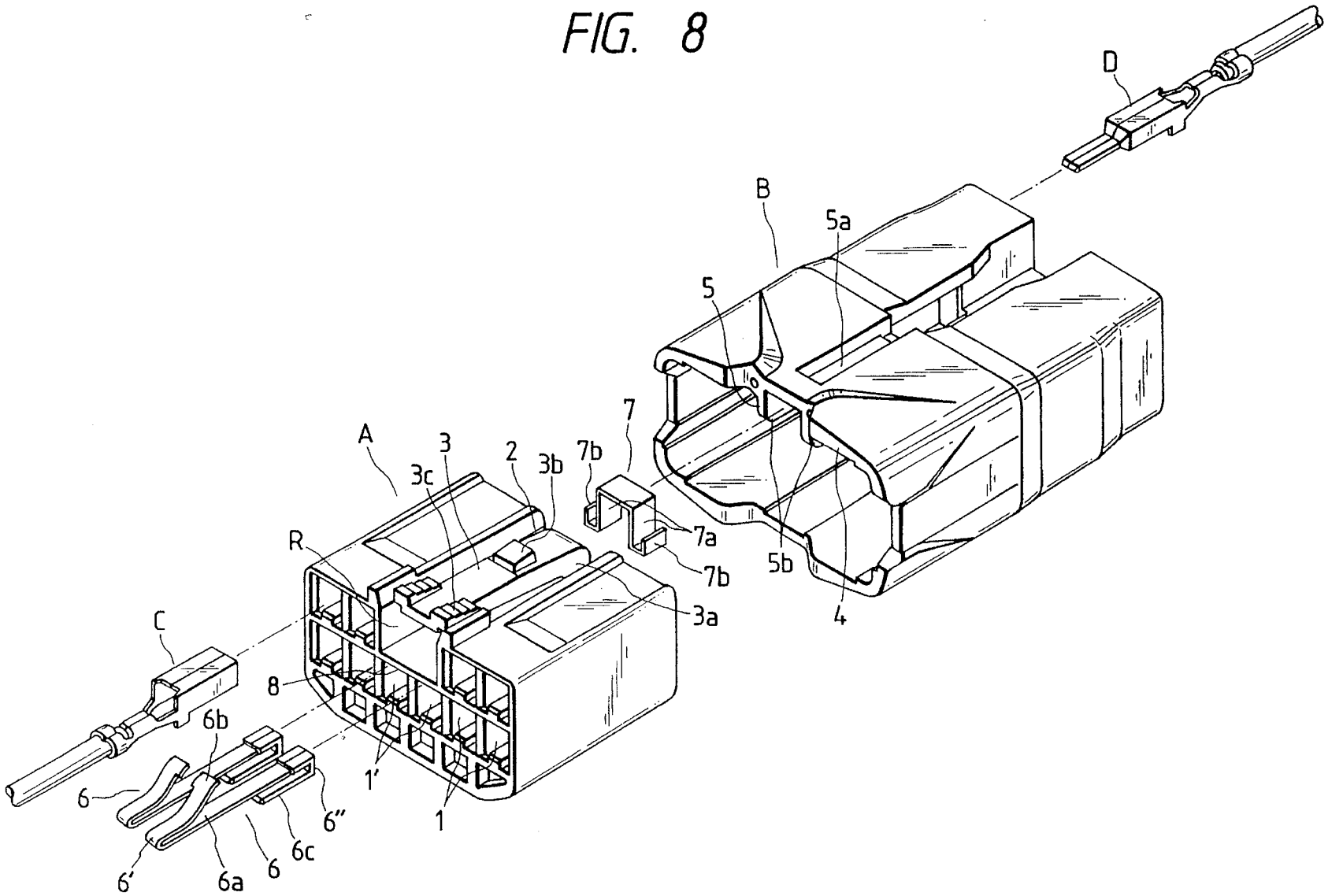
FIG. 8 is an exploded perspective view of a conventional example.
Figure 9A:
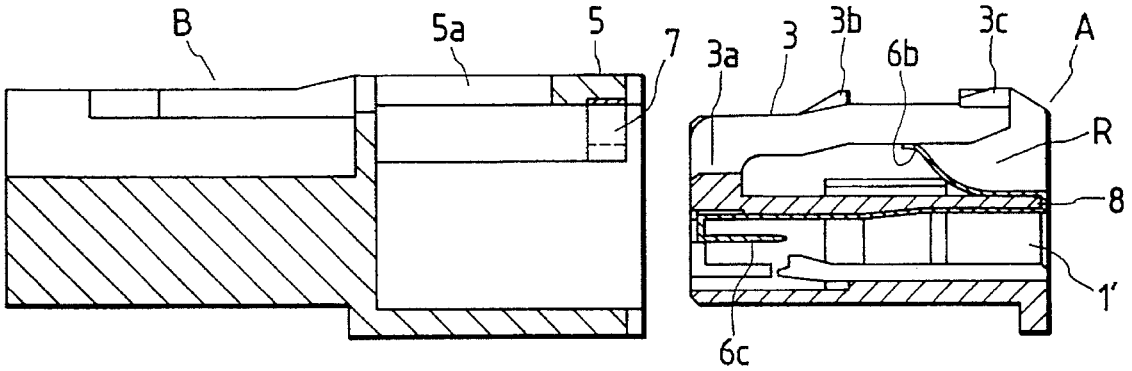
FIG. 9(*a*) is a longitudinal sectional view of the conventional example of FIG. 8 in a separated state FIG. 9(*b*) is a longitudinal sectional view of the conventional example of FIG. 8 in an incompletely connected state.
Figure 9B:
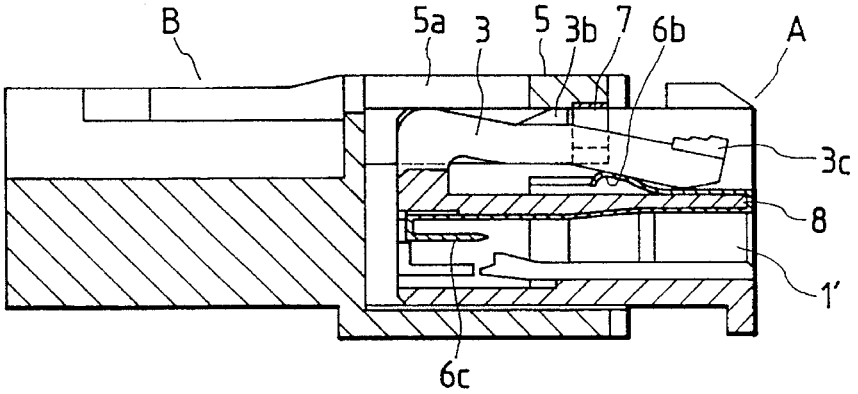
Figure 9C:
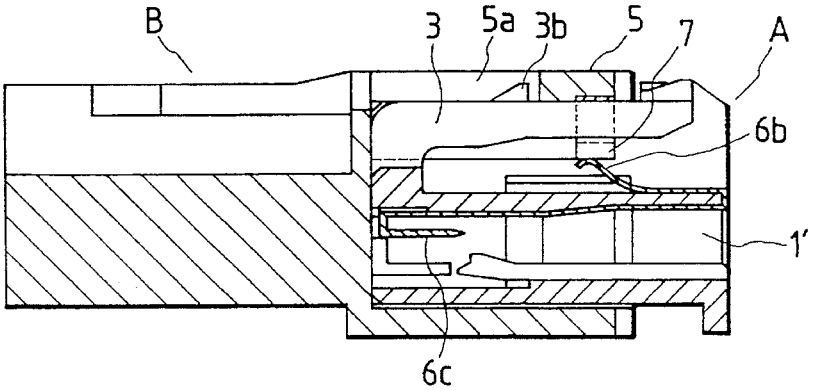

In the aforementioned construction, when the operation of connecting the male and female connector housings A', B' is initiated, the support frame portion 17 and the connection sensing pin-type terminal fittings D" enter into the opening 18 (see FIG. 5). As the connecting operation progresses, the front ends of the support frame portion 17 and the connection sensing pin-type terminal fittings D" enter into the distance R2. At this instance, the lock protuberance 14*b* gets engaged with the lower portion of the engagement frame portion 16, so that the flexible lock arm 14 is flexible displaced through the displacement allowing space $R_1$ and, in association with the flexible displacement of the flexible lock arm 14, the resilient contact pieces 19*c* of the short-circuiting contact 19 are displaced in such a direction as to increase the distance $R_2$ (i.e., the contact pieces 19*c* are deflected downwardly. Hence, the connection sensing pin-type terminal fittings D" do not contact the short-circuiting contact 19 (see FIG. 6). When the male and female connector housings A', B' have been connected completely, the flexible lock arm 14 returns to the original position thereof to cause the resilient contact pieces 19*c*, 19*c* of the short-circuiting contact 19 to return to the original position thereof. As a result, the short-circuiting points 19$c_3$, 19$c_3$ come in contact with the pair of connection sensing pin-type terminal fittings D", D" to operate the sensing electric circuit (see FIG. 7).

In the first aspect of the invention, the connection sensor can be simplified by getting rid of the conventionally employed connection sensing contacts.

In the second aspect of the invention, even if the pair of connection sensing pin-type terminal fittings to be short-circuited are displaced, the resilient contact pieces that are displaceable independently of each other come in contact with the corresponding pin-type terminal fittings, ensuring perfect short-circuiting.

In the third aspect of the invention, when the pair of resilient contact pieces receive a load of the flexible lock arm through the driven portions, the collision portions block the driven portions from falling down to thereby allow the resilient contact pieces to be displaced in accordance with the displacement of the flexible lock arm.

In the fourth aspect of the invention, displacement of the flexible lock arm can be transmitted to the resilient contact pieces efficiently In the fifth aspect of the invention, smooth contact of the resilient contact pieces with the connection sensing pin-type terminal fittings can be effected at the time of connecting the pair of housings to each other.

In the sixth aspect of the invention, durable resiliency can be imparted to the resilient contact pieces, because the resilient contact pieces are continuous from the folded resilient plate portions.

In the seventh aspect of the invention, falling down of the driven portions can be blocked when a load is applied to the driven portions.

In the eighth aspect of the invention, resiliency of the resilient plate portion is never disturbed by fixing the short-circuiting contact through the base plate portion and the cover plate portion.

What is claimed is:

1. An electrical connector comprising:

a first connector housing having a flexible lock arm extending therefrom;

a second connector housing having am engagement portion corresponding to the flexible lock arm;

a short-circuiting contact member having resilient contact pieces, the short-circuiting contact member being arranged on a displacement allowing space side of the flexible lock arm in the first connector housing, the resilient contact pieces being displaced in response to displacement of the flexible lock arm; and a pair of connection sensing pin-type terminal fittings arranged in the second connector housing so as to contact said resilient contact pieces when the first and second connector housings are completely engages with each other, wherein when said first and second connector housings are connected incompletely, the flexible lock arm is displaced to push the resilient contact pieces away from the connection sensing pin-type terminal fittings to eliminate contact therebetween and wherein said pin-type terminals are disposed substantially between said lock arm and said resilient contact pieces when the first and second housings are completely engaged with each other.

2. An electrical connector according to claim 1, wherein said short-circuiting contact member includes a pair of the resilient contact pieces corresponding to the pair of connection sensing pin-type terminal fittings, and the pair of resilient contact pieces are juxtaposed through a slit in the short-circuiting contact member.

3. An electrical connector according to claim 2, wherein a pair of driven portions confronting the flexible lock arm are respectively arranged on the pair of resilient contact pieces, and collision plate portions are arranged on a slit side of the pair of driven portion so as to minimize deflection of said driven portions.

4. An electrical connector according to claim 2, wherein the pair of driven portions arranged on the pair of resilient contact pieces are confronted with press portions of the flexible lock arm.

5. An electrical connector according to claim 2, wherein short-circuiting contact points of the resilient contact pieces confront a intermediate wall surface of the first connector housing therein in such a manner that a gap is defined between the short-circuiting contact points of the resilient contact pieces and the intermediate wall surface of the first connector housing so as to allow the connection sensing pin-type terminal fittings to enter thereinto, and the intermediate wall surface is located on said displacement allowing space side of the flexible lock arm.

* * * * *